United States Patent [19]

Langford

[11] Patent Number: 4,658,594

[45] Date of Patent: Apr. 21, 1987

[54] AIR CONDITIONING SYSTEM FOR A NATATORIUM OR THE LIKE

[76] Inventor: Wayne Langford, 27 Cygnus Dr., Richmond Hill, Ontario, Canada, L4C 7B2

[21] Appl. No.: 702,358

[22] Filed: Feb. 15, 1985

[51] Int. Cl.[4] ..... F25D 17/04

[52] U.S. Cl. ..... 62/176.5; 62/176.6; 62/238.6

[58] Field of Search ..... 62/238.6, 238.7, 176.1, 62/176.5, 176.6, 177, 178, 179, 180, 181, 79, 90, 173; 236/44 C; 237/2 B; 165/16, 29

[56] References Cited

U.S. PATENT DOCUMENTS

| | | | |
|---|---|---|---|
| 3,407,620 | 10/1968 | Lodge | 62/90 X |
| 3,976,123 | 8/1976 | Davies | 62/238.6 X |
| 4,189,929 | 2/1980 | Russell | 62/176.5 X |

FOREIGN PATENT DOCUMENTS

| | | | |
|---|---|---|---|
| 1101211 | 5/1981 | Canada . | |
| 2027347 | 12/1977 | Fed. Rep. of Germany | 62/238.6 |

*Primary Examiner*—Harry B. Tanner
*Attorney, Agent, or Firm*—Weldon F. Green

[57] ABSTRACT

A system for automatically regulating both temperature and humidity within an enclosure for a swimming pool or the like where the atmosphere and the pool water are to be maintained at a selected temperature differential, including a pool water recirculating system having a remote source for the introduction of makeup water, an air recirculating system and a refrigerant recirculating system including an evaporator disposed within the air recirculating system, and the pool water recirculating system including a heat exchange coil disposed within the air recirculating system downstream from the evaporator and a valve assembly for selectively directing the recirculated water to the coil including a bypass conduit for bypassing same, electrical resistance heaters in thermal exchange relation with the air in the air recirculating system downstream from the coil and a thermostat and dehumidistat for controlling and sensing the temperature and humidity of the atmosphere within the enclosure.

12 Claims, 1 Drawing Figure

AIR CONDITIONING SYSTEM FOR A NATATORIUM OR THE LIKE

FIELD OF INVENTION

Figure 1:
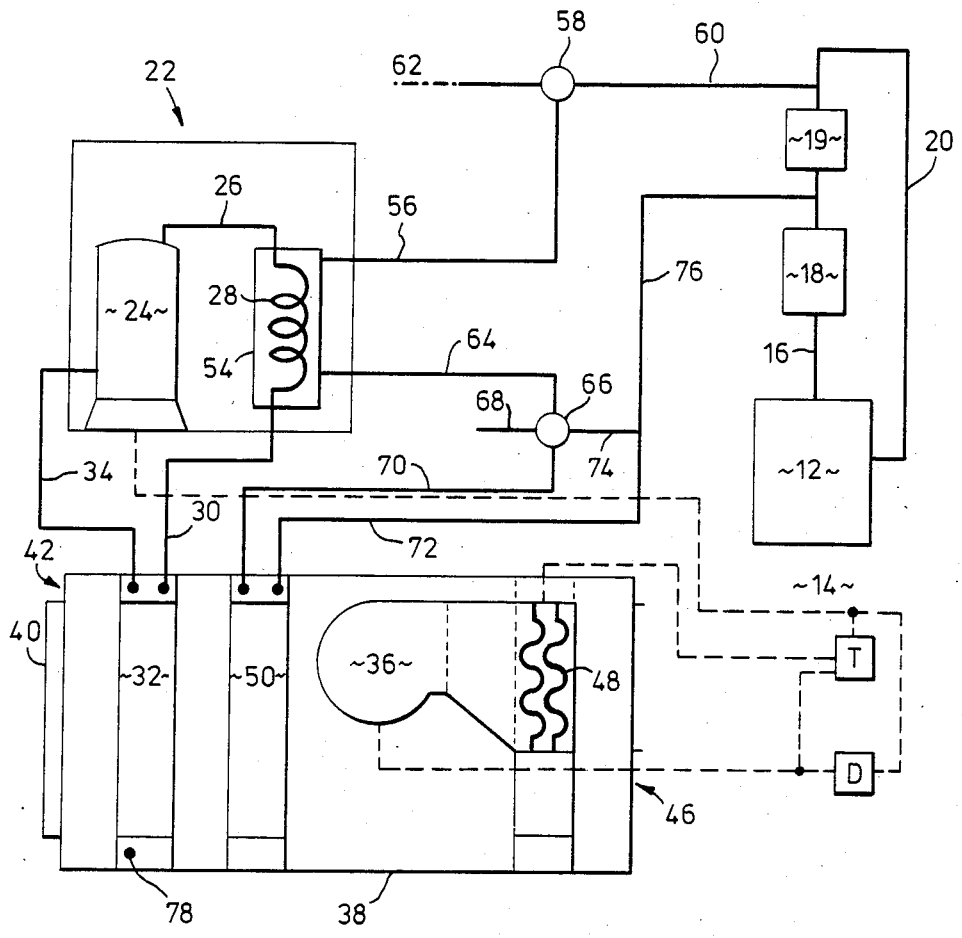

This invention relates to improvements in a system for maintaining preset conditions of temperature and humidity in an enclosure that includes a pool of water such as a natatorium or the like, and particularly wherein temperature and humidity within the enclosure and the temperature of the body of water are required to be closely controlled over a range of operating conditions for purposes of comfort as well as to conserve energy.

More particularly this invention relates to improvements in a system for dehumidifying the air within such enclosure, heating the air or cooling same as required, heating the body of water or cooling same as required, returning the condensed water vapour to the pool water and maintaining a sufficient volume of water, all within the framework of preferred conditions of comfort and efficiency and especially when applied to a natatorium or the like.

BACKGROUND TO THE INVENTION

Systems of the type under consideration normally include recirculation of a suitable refrigerant through a dehumidifying or evaporator coil and a condenser coil by means of a refrigerant compressor operated by an electric motor together with a heat generating source for adding heat to the air, if required.

Heat must be abstracted from the refrigerant as it passes through the condenser to further cool and liquify the refrigerant. This abstracted heat can be used if required to maintain the temperature of the pool water as well as the temperature of the atmosphere within the enclosure.

A fan and a conveyance are provided for drawing air from the pool enclosure over the evaporator coil to chill the air and thereby condense the water vapour thereon and so dehumidify same.

The condensed water vapour can be returned to the pool water and so maintain the required volume.

One example of such a dehumidification system is found in Canadian Pat. No. 1,101,211 wherein the arrangement includes a refrigerant compressor, a pool water heater, an air heater and a dehumidifying or evaporator coil.

Such system passes air within the enclosure through a duct over the dehumidifying evaporator coil disposed therein to chill same and then over an air heater comprised of a length or stage of the condenser coil disposed within such duct located downstream of the evaporator coil through which refrigerant can be selectively directed when additional heat for the air is required.

More particularly the refrigerant in the system outlined in C. Pat. No. 1,101,211 is recirculated from the compressor to the condensation stage comprised of a two stage condenser, one of which can be bypassed through appropriate valves and then to the evaporator, whereupon the refrigerant is returned to the compressor.

Heat available from the refrigerant within the first stage of the condenser in passing from compressor to evaporator is used, if required, to heat the pool water within the pool water recirculation system and the heat available from the second stage used, if required, to heat the dehumidified air within the duct downstream of the evaporator coil.

OBJECTS OF THE INVENTION

One object of the invention is to provide improved apparatus for dehumidifying the atmosphere within an enclosure for a natatorium or the like and so controlling the temperature of the atmosphere and water as to enhance the efficiency of the operation while maintaining a sufficient level of comfort.

More particularly it is an object of this invention to provide an improved apparatus for use with a natatorium or the like wherein the requisite humidity level and temperature differential between the atmosphere therein and the body of water can be more precisely determined and efficiently maintained thereafter so as to better preserve optimum conditions of comfort over lengthy intervals of time and which will be operable over a wide range of ambient temperatures.

Still another very important object is to provide an improved dehumidifying and temperature regulating system which functions with a minimum number of readily available components in a more simplified arrangement, as compared with earlier systems, thereby allowing for ready installation and easy maintenance.

Another important object is to provide apparatus which can complement existing systems as well as be installed in most locations with minimum alterations to the structure and at reduced cost.

FEATURES OF THE INVENTION

One important feature of this invention resides in utilizing water originating within the swimming pool recirculation system as the principal medium for controlling the transfer of heat energy within such system first from the refrigerant in the condensate stage to the recirculated pool water through heat exchange apparatus and, if required, from such recirculated pool water to the dehumidified air downstream of the evaporator by selectively directing all or a proportion of such pool water from such heat exchange apparatus to a coil disposed within the dehumidified air pathway so as to add sufficient heat to the air directed back to the enclosure.

It is also a feature of this invention to control the temperature of the system by providing for the delivery of a selected volume of additional input or make-up water to the system from an outside or remote source at a lower temperature such as from a municipal water supply and withdrawing or discharging a like or sufficient volume of pool water at the higher temperature whereby the overall temperature of the system can be lowered.

More particularly, by selectively channeling the recirculated pool water or the combination of pool water and make-up water first to the heat exchange apparatus and then directing or streaming same to the coil located in the dehumidified air pathway heat energy can either be returned to or extracted from the system so that preset conditions of temperature and humidity can be effectively maintained.

Still more particularly, where heat energy of the system is below the selected level as already indicated one ready source of energy to raise the temperature of the pool water and the atmosphere of the enclosure is that derived from the heat energy extracted from the refrigeration cycle in the condensation stage by the recirculated pool water which heat energy can be transmitted to the dehumidified air by directing or streaming some or all of the recirculated pool water to the heat transfer coil located in the flow path of the air.

It is a feature of this invention to so select the heat dissipating or transfer capacity of the coil as to substantially match the heat transfer capacity of the heat exchange apparatus so as to be capable of substantially returning the energy abstracted from the system back into the air and thereby increase efficiency as well as contribute to the stability of the system.

Such air can be additionally heated if required from electrical resistance elements appropriately placed further downstream of the coil in the flow path of the air or by means of other suitably located heating devices such as gas-fired appliances.

When the heat energy of the system is to be lowered to a new selected level, dissipation of the heat energy of the pool water and of the atmosphere is accomplished by the introduction of sufficient make-up water at a lower temperature into the pool water recirculation system and appropriate channeling of same within the circuitry of the system and the withdrawal of a selected volume of pool water at the higher temperature whereby the overall temperature within the system can be effectively lowered and the atmosphere set to the desired temperature and humidity levels.

Further, it is a feature of the invention with the foregoing arrangement of recirculated pool water or mixture of make-up water from a remote source at a lower temperature and which can be first directed to the heat exchange apparatus and then selectively directed or streamed in whole or in part to the coil located in the path of the dehumidified air, the temperature and humidity can be more closely controlled, either as to adding or subtracting heat energy; but particularly when the pool water or pool water and make-up water mixture upon passing through the heat exchange apparatus or in bypassing such apparatus is at a lower temperature than the dehumidified air, by directing such pool water or mixture to the coil in the dehumidified air pathway additional heat can be abstracted from the already chilled air to further lower the air temperature and so establish selected conditions.

It is also a feature of this invention that the improved apparatus readily submit to automatic control and regulation through temperature and humidity sensing instrumentation which can selectively energize circuitry including switches to operate compressor motors, fans and heat generating facilities and control valves.

These and other objects and features are outlined in the following description which is to be read in conjunction with the sheet of the drawing wherein:

FIG. 1 is a diagrammatic layout of the components and novel circuitry by which the improved method for dehumidifying a natatorium or the like can be implemented.

According to the invention a typical natatorium of the type under consideration will include a pool 12, an enclosure 14 for such pool, a recirculation conduit or line 16 leading from pool 12 first to recirculation pump 18 and then to filter 19 arranged in series with the pool water return conduit or supply line 20, all as indicated in the schematic outline shown in FIG. 1 of the accompanying drawing.

A typical dehumidification apparatus 22 for dehumidifying the atmosphere within a pool enclosure 14 utilizes a suitable refrigerant such as freon and includes compressor 24, discharge line 26 leading from compressor 24 to condenser coil 28, liquid line 30 leading frm condenser coil 28 to the evaporator 32 and a suction line 34 leading from evaporator 32 back to compressor 24.

The compressor 24 is operated by an electric motor, not indicated.

According to the invention a fan 36 is provided for drawing air from the natatorium enclosure 14 to be dehumidified and includes a conveyance or duct 38 for channeling the air to be recirculated, an air filter 40 in registration with the upstream end 42 of conveyance 38, with fan 36 mounted within the downstream end 46 of conveyance 38 and discharging air through electrical resistance heaters 48 which can be selectively energized through appropriate controls - namely, thermostat T to deliver heat to such air.

Other sources of heat such as that supplied by a gas fired appliance can be used in place of electrical resistance heaters 48.

Evaporator 32 of the dehumidification apparatus 22 is disposed within conveyance or duct 38 downstream of air filter 40.

Mounted still further dwnstream of evaporator 32 but within conveyance or duct 38 is a coil 50 connected to the pool water recirculation system and to which pool water may be selectively directed and passed therethrough to heat or abstract heat from the air drawn through the conveyance 38 as will be explained.

According to the invention condenser coil 28 of dehumidification apparatus 22 is normally adapted to be cooled by pool water supplied to a heat exchange apparatus 54 within which condenser 28 is mounted by way of conduit section or line 56 leading from a control valve 58 located in supply line 60, control valve 58 being selectively operable to direct water either from a water source 62 at a lower temperature such as a municipal water line, or from supply line 60 of the pool water recirculation system or a mixture thereof to conduit section 56 leading to heat exchanger 54.

Pool water or pool water mixed with make-up water derived from the municipal water supply 62 or other outside source can be directed by conduit section 56 to heat exchanger 54 to abstract heat from the refrigerant in condenser coil 28 of dehumidification apparatus 22 and then delivered to a conduit section 64 leading to a second control valve 66.

Control valve 66 is selectively operable to either discharge in whole or in part recirculated pool water from the system through an outlet 68, or to direct in whole or in part such pool water to conduit section or line 70 leading to coil 50 located in conveyance 38, such water passing through coil 50 to conduit section or line 72 which joins conduit section 74 leading from control valve 66 to return through conduit section 76 to the downstream side of recirculation pump 18 in the pool water recirculation system.

The heat exchange capacity for heat exchanger 54 is determined having regard to the volume of the enclosure 14 and the volume of air to be recirculated having regard to conditions of temperatures to be imposed.

The heat exchange capacity of coil 50 is likewise determined and preferably matched to that of the heat exchanger 54 so that the system is balanced in terms of energy abstracted and returned through coil 50 so as to better maintain stable conditions over an extended period of time.

Control valve 66 is also operable to direct water only through conduit section or line 74 bypassing conduit section 70 and coil 50, conduit section or line 72 thereby redelivering all of the pool water or that derived from heat exchanger 54 back to the pool recirculation system through conduit section 76.

AIR CONDITIONING

Dehumidistat D, located in the natatorium enclosure 14, is provided to sense the degree of saturation of the natatorium enclosure atmosphere with water vapour and is adapted at a selected level to electrically energize the electrical circuitry controlling the operation of compressor 24 and fan 36.

When the humidity within the enclosure or housing 14 exceeds the level established by the setting of dehumidistat D the motors for compressor 24 and fan 36 are energized, fan 36 drawing moist air from enclosure 14 into conveyance 38 first through air filter 40 where particles or dust in the air are collected and then through evaporator 32 wherein the air is chilled and moisture therein condensed on the evaporator surfaces and collected for discharge to a drain 78 which returns the condensate directly to the pool water.

The cooled dehumidified air drawn through evaporator 32 is then passed through coil 50. Provided coil 50 is supplied with pool water at a temperature sufficiently exceeding the chilled dehumidified air, heat energy will be transferred to the chilled air before it is returned to the pool enclosure.

Should coil 50 be supplied with pool water, make-up water or a mixture thereof at a temperature sufficiently lower than the chilled dehumidified air further heat energy will be abstracted from the air before it is returned to the enclosure 14.

At the same time thermostat T, located in the natatorium enclosure 14 establishes requisite tempeature conditions and is operable to selectively energize circuitry controlling the fan 36 and electrical resistance heaters 48.

When the temperature of the air within the pool enclosure 14 falls below the level established by the setting of thermostat T fan 36 and electrical resistance heaters 48 are energized, the air from the pool enclosure 14 being drawn by fan 36 first through the air filter 40 then through the evaporator 32 where the air is chilled and the moisture therein condensed then through the coil 50 where the air may be heated by the energy derived from the pool water directed therethrough and finally through the energized electrical resistance heaters 48 which imparts additional requisite heat to restore the air to the level established by thermostat T.

Should dehumidistat D, located in the pool enclosure 14, sense that the degree of saturation of the enclosure atmosphere with water vapour is insufficient to require dehumidification and thermostat T, located in the natatorium enclosure 14, senses that the temperature of the air within enclosure 14 has fallen below the level established by the setting of thermostat T, then only fan 36 and electrical resistence heaters 48 are energized.

Since compressor 24 has not been energized by dehumidistat D no chilling of the air passing through evaporator 32 takes place and no heating of the air passing through coil 50 takes place, thus only the electrical resistance heaters 48 impart the requisite heat to restore the air to the level established by thermostat T.

When the temperature of the air within the pool enclosure 14 is to be lowered to a new selected temperature thermostat T energizes fan 36, and compressor 24, the air from the enclosure 14 being drawn by fan 36 first through the air filter 40 then through the evaparator 32 where the air is chilled and the moisture therein condensed. By adjusting valve 66 pool water, make-up water, or a mixture thereof can selectively bypass conduit 70, coil 50 and conduit 72. The air from the evaporator 32 in passing through coil 50 will thus receive no heat energy from coil 50 and is discharged to enclosure 14 in a chilled state so as to lower temperature of same to the new selected temperature.

The temperature of the atmosphere of enclosure 14 can also be lowered by the introduction of water at a lower temperature from an outside source such as the municipal water supply 62. Such water can be added and directed through the operation of control valve 58 to conduit section 56 to heat exchanger 54 and then to conduit section 64 leading to control valve 66. Control valve 66 is then adjusted so as to selectively supply coil 50 with such municipal water to abstract further heat energy from the air before it is returned to the enclosure 14. Excess water can be discharged through outlet 68 to thereby maintain a constant volume of pool water.

WATER CONDITIONS

Normally, water from the pool 12 is recirculated by way of recirculation line 16 through filter 19 by means of the recirculation pump 18.

Upon evaporation of pool water into the atmosphere within the enclosure or housing 14 heat energy is withdrawn and the pool temperature falls.

According to the invention, the heat generated by the dehumidification apparatus 22 can be recovered and transferred to the pool water and so aid in restoring the temperature of same to the required setting. Moreover, where, as here, the humidity of the air of the enclosure or housing 14 normally will increase, which requires the chilling of the air to condense the excess moisture, the heat generated by the dehumidification apparatus 22, likewise can be utilized to restore the temperature of the chilled air to the desired level.

Where it is required to restore the temperature of the pool water to the desired level as determined by thermostat T in the enclosure 14 such water is directed to heat exchanger 54 by positioning valve 58 to divert all or a part of the recirculated pool water along supply line or conduit 60 to valve 58 then to conduit 56 communicating with heat exchanger 54.

The temperature of that part of the pool water diverted to heat exchange apparatus to abstract heat from hot refrigerant in condenser coil 28 is raised and the pool water returned to the pool through the conduit 64, valve 66 bypass conduit 74 and conduit 76 thereby restoring the pool water to the requisite temperature level.

In a case where the temperature of the air within enclosure 14 falls below the setting of thermostat T measuring same, part or all of the pool water diverted to heat exchanger 54 through conduit 60 valve 58 and conduit 56 may be directed to conduit 64, valve 66 and conduit 70 to the coil 50.

The surrendering of heat by the pool water in coil 50 to the chilled air drawn through conveyance 38 by fan 36 cools the water which is then channeled by means of conduit 72 back to the pool water recirculation system. By selectively adjusting valve 66 the pool water temperature can be adjusted by regulating the amount of cool water channelled through conduit 72 to be mixed with the warm water from the heat exchanger 54 via bypass conduit 74.

By adjusting valve 66 a temperature differential between the air within enclosure 14 and the pool water of pool 12 can be established and maintained thereafter.

Thermostat T, measuring the temperature of the air within the enclosure 14, causes the electrical resistance heaters 48 to be energized when the temperature of the air falls below the desired level, thereby providing additional heat to the reheated air derived from the reheat coil or air heater 50.

Accordingly, it will be understood that by adjusting valve 66 an initial temperature differential can be established from the desired thermostat setting since the pool water temperature can be altered in relation to the air temperature due to the exchange of heat in the interaction between the pool water streaming through coil 50 and the air drawn by fan 36 into the conveyance 38 with a stability achieved in a particular installation by substantially matching the heat exchange apparatus of the heat exchanger 54 and heat transfer coil 50.

Once established, the temperature differential between pool water and air is self-sustaining until valve 66 is further adjusted or until the setting of thermostat T is altered.

In the case where the air temperature within enclosure 14 is to be lowered to a selected value theremostat T will energize the circuitry including the compressor 24 whereby air drawn through conveyance 38 by fan 36 will be chilled as it passes over evaporator coil 32.

One step further to be taken to lower the temperature of the atmosphere of the enclosure 14 is that water at a lower temperature from an outside source be added to the system, for example from the municipal water supply 62. Such source water 62 can be introduced through the operation of control valve 58 and control valve 60 to coil 50.

Municipal Water 62 upon flowing through conduit 64 to valve 66 can be discharged through outlet 68 thereby maintaining a constant volume of pool water, yet effectively lowering the temperature of same which in turn increases the temperature differential between the atmosphere of enclosure 14 and the pool water.

It will be understood that variations or modifications can be undertaken to the preferred system illustrated and described by those persons skilled in the art without departing from the spirit and scope of the invention as defined by the appended claims.

What I claim is:

1. In a system for automatically regulating both temperature and humidity within an enclosure for a swimming pool installation or the like wherein the pool installation includes conduit circuit means and pump means for recirculating pool water, an air conditioning system for said enclosure including duct means and fan means disposed within said duct means for directing and recirculating the air within the enclosure, and refrigerant circuit means for chilling the recirculated air including compressor means having a discharge side and a suction side, condenser means disposed downstream of said compressor means, and evaporator means disposed downstream from said condenser means within said duct means and in thermal exchange relation with the air to be directed therethrough for chilling same, heat exchange means disposed between said conduit circuit means and said condenser means whereby heat derived from said condenser means is transferable from refrigerant therein to pool water recirculating within said conduit circuit means, said conduit circuit means downstream of said heat exchange means including heat transfer coil means disposed within said duct means downstream from said evaporator means and in thermal exchange relation with air to be directed therethrough, the capacity of said heat exchange means and said heat transfer coil means of substantially the same order such that the heat transferable to the pool water through said heat exchange means substantially equals the heat transferable to the air through said heat transfer coil means, and valve means for selectively directing said recirculating pool water to said heat transfer coil means or for bypassing same.

2. A system according to claim 1 wherein means for generating heat energy in thermal exchange relation with air directed through said duct means is disposed downstream from said heat transfer coil means and is selectively operable to generate additional heat energy for transfer to such directed air.

3. A system according to claims 1 or 2 wherein said valve means selectively directing said recirculating pool water to said heat transfer coil means or bypassing same includes conduit means for discharging pool water from said conduit circuit means.

4. In a system for automatically regulating both temperature and humidity within an enclosure of a natatorium or the like and an air conditioning system therefore, wherein the atmosphere within the enclosure and the pool water are to be maintained at a selected temperature differential, said pool water installation including conduit circuit means and pump means for recirculating said pool water and for the introduction of make-up pool water thereinto from a remote source, said air conditioning system including conveyance means and fan means disposed within said conveyance means for recirculating the air within the enclosure, and refrigerant circuit means for chilling the recirculated air including compressor means having a discharge side and suction side, condenser means disposed downstream from said compressor means and evaporator means disposed downstream from said condenser means within said conveyance means in thermal exchange relation with the air recirculated through said conveyance means for chilling same, said conduit circuit means and refrigerant circuit means including heat exchange means whereby heat derived from said condenser means is transferred from the refrigerant to the recirculating pool water within said pool water conduit circuit means, said pool water circuit means downstream of said heat exchange means including heat transfer coil means disposed within said conveyance means downstream from said evaporator means, the capacity of said heat exchange means and said heat transfer coil means of substantially the same order such that the heat transferable to the pool water through said heat exchange means substantially equals the heat transferable to the air through said heat transfer coil means, means for selectively connecting and isolating said heat transfer coil means from said recirculating pool water including valved bypass conduit means for bypassing said heat transfer coil means, means for generating additional heat energy in thermal exchange relation with said air disposed within said conveyance means downstream from said heat transfer coil means, temperature controlling and sensing means for controlling and sensing the temperature of the atmosphere within said enclosure and humidistat controlling and sensing means for controlling and sensing the humidity of the atmosphere within said enclosure, and means responsive to said humidity sensing means for controlling said compressor means and said fan means in response to a variation in the humidity of the atmosphere within said enclosure, and means responsive to said temperature sensing means for controlling said fan means and said means for generating additional heat energy in thermal exchange relation with said air disposed within said conveyance means downstream from said heat transfer coil means.

5. A system according to claim 4 including switch means responsive to said temperature sensing means only for energizing said fan means and said compressor means simultaneously to lower the temperature within the enclosure to a selected level.

6. In a conditioning system for automatic regulation of both temperature and humidity in an enclosure that includes a pool water installation or the like and an air conditioning system wherein the atmosphere and pool water are to be maintained at a selected temperature differential over a range of values, said pool water installation including circuit means for directing recirculation of said pool water and for introduction of make-up pool water thereinto from a remote source, and said air cnditioning system includes air flow path means for directing recirculation of the air, and a refrigerant circuit including compressor means having a discharge side and a suction side, a condenser disposed downstream of said compressor means in thermal exchange relation with said pool water recirculation system, and an evaporator disposed downstream from said condenser in thermal exchange relation with said air within said air flow path means, said pool water recirculation system downstream of said condenser including reheat coil means located downstream from said evaporator and disposed within said air flow path in thermal exchange relation therewith, the capacity of said condenser and said reheat coil means of substantially the same order such that the heat transferable to the pool water through said condenser substantially equals the heat transferable to the air through said reheat coil means, means for selectively isolating said reheat coil means from said pool water recirculation system including valved bypass conduit means for bypassing said reheat coil means, means for generating heat energy in thermal exchange relation with said air within said air flow path means located downstream from said reheat coil means, fan means for delivering the air from said enclosure along said air flow path and pump means for recirculating the water in said pool water recirculation system, temperature sensing means for sensing the temperature of the atmosphere within said enclosure, humidistat means for sensing the humidity of the atmosphere within said enclosure and electrical circuit means for energizing said compressor means, and said fan means in response to a variation in said temperature sensing means in response to a temperature change, and in response to a variation in said humidity sensing means in response to a humidity change.

7. A conditioning system according to claim 6 wherein said electrical circuit means actuates said fan means, and said means for generating heat energy in thermal exchange relation with said air within said air flow path means downstream of said reheat coil means for providing additional heat energy to said air in thermal exchange relation therewith for complementing said reheat coil means in thermal exchange with said air within said air flow path means in a response to a variation in said temperature sensing means in response to a temperature change.

8. A conditioning system according to claim 6 wherein said valved bypass conduit means for bypassing said reheat coil means includes conduit means for directing water to an external sink in amounts equal to external source water selectively introduced into said pool water recirculation system through said conduit means for introducing said make-up water thereinto from a remote source.

9. A conditioning system according to claim 8 wherein said electrical circuit means actuates said fan means and said compressor means in response to a variation in said temperature sensing means in response to a temperature change.

10. In a conditioning system for automatic regulation of both temperature and humidity in an enclosure that includes a pool water installation or the like and an air conditioning system wherein the atmosphere and pool water are to be maintained at a selected temperature differential over a range of values, said pool water installation including conduit means for directing recirculation of said pool water and for introduction of make-up pool water thereinto from a remote source, and said air conditioning system includes air flow path means for directing recirculation of the air and a refrigerant circuit including compressor means having a discharge side and a suction side, a condenser disposed downstream of said compressor means in thermal exchange relation with said pool water recirculation system and an evaporator downstream of said condenser in thermal exchange relation with said air disposed within said air flow path means, said pool water recirculation system downstream of said condenser including reheat coil means located downstream from said evaporator and disposed within said air flow path in thermal exchange relation therewith, the capacity of said condenser and said reheat coil means of substantially the same order such that the heat transferable to the pool water through said condenser substantially equals the heat transferable to the air through said reheat coil means, means for selectively isolating said reheat coil means from said pool water recirculation system including valved bypass conduit means for bypassing said reheat coil means, means for generating heat energy in thermal exchange relation with said air within said air flow path means located downstream from said reheat coil means, fan means for delivering the air from said enclosure along said air flow path and pump means for recirculating the water in said pool water recirculation system, temperature sensing means for sensing the temperature of the atmosphere within said enclosure, humidistat means for sensing the humidity of the atmosphere within said enclosure, and said electrical circuit means for actuating said fan means and said means for generating heat energy in thermal exchange relation with said air within said air flow path means for providing additional heat energy to said air in thermal exchange relation therewith, for complementing said reheat coil means in thermal exchange with said air within said air flow path means in a response to a variation in said temperature sensing means in response to a temperature change, and said fan means and said compressor means in a response to a variation in said humidity sensing means in response to a humidity change.

11. A conditioning system according to claim 10 wherein said valved bypass conduit means for bypassing said reheat coil means includes conduit means for directing water to an external sink in amounts equal to external source water selectively introduced into said pool water recirculation system through said conduit means for introducing said make-up water thereinto from a remote source.

12. A conditioning system according to claim 11 wherein said electrical circuit means actuates said fan means and said compressor means in response to a variation in said temperature sensing means in response to a temperature change.

* * * * *